United States Patent [19]

Hokamura et al.

[11] Patent Number: 4,508,767

[45] Date of Patent: Apr. 2, 1985

[54] PROCESS FOR FORMING A CORROSION RESISTANT COATING

[75] Inventors: Sadakazu Hokamura, Yamato; Toshio Shinohara, Yokohama; Mitsutoshi Aritomi; Yuji Yoshida, both of Ibaraki, all of Japan

[73] Assignees: Dai Nippon Tokyo Co., Ltd, Osaka; Mitsubishi Yuka Fine Chemicals Co., Ltd., Tokyo, both of Japan

[21] Appl. No.: 556,328

[22] Filed: Nov. 30, 1983

[30] Foreign Application Priority Data

Dec. 28, 1982 [JP] Japan ..... 57-229956
Dec. 28, 1982 [JP] Japan ..... 57-229957

[51] Int. Cl.[3] ..... B05D 1/36
[52] U.S. Cl. ..... 427/407.1; 427/386; 427/409; 427/410
[58] Field of Search ..... 427/386, 409, 410

[56] References Cited

U.S. PATENT DOCUMENTS

| | | | |
|---|---|---|---|
| 4,098,928 | 7/1978 | Noomen et al. | 427/203 |
| 4,147,675 | 4/1979 | Aritomi | 525/7 |
| 4,279,962 | 7/1981 | Meyer et al. | 427/410 X |
| 4,346,143 | 8/1982 | Young, Jr. et al. | 427/410 X |
| 4,396,650 | 8/1983 | Lange et al. | 427/409 |

*Primary Examiner*—Thurman K. Page
*Attorney, Agent, or Firm*—Oblon, Fisher, Spivak, McClelland & Maier

[57] ABSTRACT

A process for forming a moisture resistant coating, which comprises:

(i) a step of priming a coating composition on a substrate and drying it to form a prime coat, (ii) a step of coating thereon a radical-polymerizable and oxidation-polymerizable, room temperature solventless coating composition containing a scaly pigment and polymerizing it to form a cured intermediate coat, and (iii) a step of finish coating thereon an air-drying finish coating composition and drying it to form an finish coat.

5 Claims, No Drawings

PROCESS FOR FORMING A CORROSION RESISTANT COATING'

The present invention relates to a process for forming a coating which is superior in various properties such as moisture resistance, water resistance and corrosion resistance. More particularly, the present invention relates to a process for forming such a superior coating, which comprises applying a solvent-type primer coating composition onto a substrate and drying it to form a prime coat, then applying on the prime coat a solventless intermediate coating composition containing a scaly pigment and drying it to form an intermediate coat, and finish coating an air-drying type finish coating composition on the intermediate coat.

For the protection of substrates such as tanks, bridges, steel-frame structures or pipes which need to be protected for a long period of time, various solvent-type and solventless coating compositions have been employed in various combinations for the primer coating and finish coating of such substrates.

For instance, taking into consideration the selectivity to the primer, etc., various combinations of coating compositions, such as oil type coating composition/-phenol resin type coating composition/chlorinated rubber type coating composition, organic or inorganic zinc-rich paint/chlorinated rubber type coating composition, epoxy resin type coating composition/polyurethane type coating composition, and epoxy resin type coating composition/epoxy resin type coating composition, have been employed for the coatings.

However, even when a substrate is coated with such a coating system, it has been impossible to attain adequate protection of the substrate for an extended period of time by the coating film if the substrate is subjected to a severe environment where water drops or ice always exists, as in the case of hydraulic pipes at a water-power plant or if it is immersed in water as in the case of a water gate. Namely, since cool water is always circulated in the hydraulic pipes, and the outer surface thereof always has water drops thereby formed except for the winter time. Otherwise, they are immersed in water. Consequently, blisters are likely to form on the coating film in about 6 to 15 months after the application of the coating, and rust formation proceeds simultaneously.

On the other hand, in view of the rapid increase in the labour costs for the coating operation, it is desired to have a coating composition developed which has a long interval for recoating i.e. which has superior durability and is capable of protecting the substrate from corrosion over an extended period of time.

In general, corrosion of iron is known to occur when water and oxygen simultaneously exist on the surface of the iron substrate. Accordingly, it is considered possible to protect iron for a long duration with the coating film either by preventing either water or oxygen from penetrating through the coating film or by reducing the rate of the penetration.

From the above-mentioned viewpoint, the present inventors have conducted extensive researches on various coating systems and have finally found that it is possible to improve various properties of the coating film, such as moisture resistance, water resistance and corrosion resistance without substantially changing the primer and finish coating compositions in the conventional coating systems, simply by changing the intermediate coating composition, namely by using as the intermediate coating a solventless coating composition comprising a resin composition which contains a scaly pigment and which has a minimum oxygen permeability. The present invention has been accomplished based on this discovery.

In the conventional coating systems, the intermediate coating composition usually contains a less amount of a filler pigment than the primer coating composition and is primarily intended to improve the interlayer adhesion and the finishing of the finish coating. Among the conventional coating systems, there is a coating system of an oil-type and/or alkyd resin type primer coating composition-a phenol resin type intermediate coating composition containing micaceous iron oxide (hereinafter referred to simply as "MIO")—a chlorinated rubber type finishing coating composition. In this coating system, the intermediate coating composition contains a scaly pigment. However, in this case, such an intermediate layer is primarily intended to prevent so-called "lifting" which may occur when the finish coating is directly applied on the primer coating, or to improve the adhesion of the finish coating by virtue of the roughened surface of the intermediate coating due to the presence of MIO, so that the interval for the recoating of the finish coating may thereby be prolonged. Therefore, no substantial improvement is thereby expected with respect to the moisture resistance, water resistance and corrosion resistance of the coating film, which the present invention is concerned with.

Namely, the MIO-containing phenol resin type coating composition is a solvent-type coating composition. Accordingly, when the solvent is to be evaporated, MIO tends to hinder the evaporation. Further, even when the solvent has eventually been evaporated, the formed coating film tends to have a porous structure, whereby it is substantially difficult to expect an improvement in the moisture resistance, water resistance and corrosion resistance of the coating film by itself.

In the field of the epoxy resin coating systems, it has recently been proposed to use a MIO-containing epoxy resin as the intermediate coating composition. However, such a coating composition provides no substantial improvement over the above-mentioned conventional intermediate coating composition.

Further, none of the conventional coating systems provides a totally satisfactory combination of the finish coating composition with a primer coating composition in respect of the selectivity of the finish coating composition to the primer coating composition or in respect of the inter-layer adhesion.

It is an object of the present invention to overcome or minimize the above-mentioned drawbacks of the conventional coating systems and to provide a process for forming, by means of a specific intermediate coating composition, a coating film having superior properties such as moisture resistance and being durable for a long period of time without forming coating defects such as rusts or blisters, whereby it is yet possible to select a primer coating composition for the intermediate coating composition within a wide range of coating compositions.

One of the present inventors has previously proposed a coating composition comprising an oil-modified alkyd resin having an oil length of from 30 to 70% and modified with sorbic acid, crotonic acid or 2-($\beta$-furyl) acrylic acid, and a polymerizable monomer (U.S. Pat. No. 4,147,675). It is another object of the present invention to provide a process for forming a coating film having superior properties such as moisture resistance by using such an oil-modified alkyd resin composition as the intermediate coating composition or as a part of the finish coating composition.

Thus, the present invention provides a process for forming a moisture resistant coating, which comprises:

(i) a step of priming a solvent-type coating composition on a substrate and drying it to form a prime coat, (ii) a step of coating thereon a radical-polymerizable and oxidation-polymerizable, room temperature curing type solventless coating composition containing a scaly pigment and polymerizing it to form a cured intermediate coat, and (iii) a step of finish coating thereon an air-drying type finish coating composition and drying it to form a finish coat.

The above-mentioned solvent-type coating composition to be used as the primer coating composition in the present invention is a composition wherein a vehicle is diluted with a volatile organic solvent. As such a composition, there may be mentioned, for instance, an oil-type coating composition, a solvent-type alkyd resin coating composition, a solvent-type epoxy resin coating composition, a solvent-type polyurethane coating composition, a solvent-type chlorinated rubber coating composition, and a solvent-type vinyl resin coating composition. These solvent-type coating compositions may be used alone or in combination as a mixture of at least two different types.

The above-mentioned oil-type coating composition is a composition wherein a boiled oil such as tung oil or soybean oil, or such a boiled oil partially substituted by a petroleum resin or by an alkyd resin, is used as the vehicle.

More specifically, the above-mentioned alkyd resin coating composition is a composition wherein a resin obtained from an oil or its fatty acid, a polyhydric alcohol and a polybasic carboxylic acid or its anhydride by a known esterification reaction, is used as the vehicle. The esterification is carried out at a temperature of from 150° to 280° C., while removing water which forms during the reaction. The end of the reaction is determined by measuring the acid value or the amount of water formed by the esterification reaction.

From the viewpoint of the coating film properties, the acid value at the completion of the reaction is preferably at most 50.

As the oil or the fatty acid to be used for the preparation of the above-mentioned alkyd resin, there may be mentioned oils such as castor oil, cotton seed oil, dehydrated castor oil, linseed oil, safflower oil, soybean oil and tung oil, or fatty acids thereof.

The oil or the fatty acid is used preferably in an amount of from 5 to 70% by weight, based on the total composition for the preparation of the alkyd resin.

As the polyhydric alcohol to be used for the preparation of the alkyd resin, there may be mentioned, for instance, ethylene glycol, diethylene glycol, triethylene glycol, propylene glycol, dipropylene glycol, butanediol-1,3, butanediol-1,4, butanediol-2,3, pentanediol-1,5, hexanediol-1,6, neopentyl glycol, 2,2,4-trimethylpentanediol-1,3, hydrogenated bisphenol A, 2,2-di(4-hydroxypropoxyphenyl)propane, glycerol, pentaerythritol, diallyl ether, trimethylene glycol, 2-ethyl-1,3-hexanediol, trimethylol propane, cyclohexane dimethanol-1,4, 2,2,4-tetramethylcyclobutanediol-1,3, 1,4-bis(2-oxyethoxy)benzene, and 2,2,4,4-tetramethylcyclobutanediol-1,3. These alcohols may be used alone or in combination as a mixture.

As the saturated or unsaturated polybasic carboxylic acid or its anhydride to be used for the preparation of the alkyd resin, there may be mentioned, for instance, maleic acid, fumaric acid, itaconic acid, citraconic acid, mesaconic acid, maleic anhydride, phthalic anhydride, isophthalic acid, terephthalic acid, hexahydrophthalic anhydride, tetrahydrophthalic anhydride, tetrabromophthalic anhyhdride, tetrachlorophthalic anhydride, chlorendic acid, 3,6-endomethylene-tetrahydrophthalic anhydride, trimellitic anhydride, pyromellitic anhydride, methylnadic acid, succinic acid, adipic acid, sebacic acid, azelaic acid, an anthrathene-maleic anhydride adduct and a rosin-maleic anhydride adduct. These acids and anhydrides may be used alone or in combination as a mixture. If desired, a conventional unsaturated monocarboxylic acid may be used in combination therewith.

Further, it is possible to use a modified alkyd resin obtained by polymerizing the above-mentioned alkyd resin with a polymerizable monomer which will be described hereinafter.

The epoxy resin coating composition to be used in the coating process of the present invention, is a composition comprising an epoxy resin, a hardener and, optionally, various pigments, solvents or other additives.

As the epoxy resin, there may be mentioned a resin having at least two epoxy groups in its molecule, for isntance, (1) a resin synthesized by the reaction of bisphenol A or bisphenol F with epichlorohydrin or methylepichlorohydrin, such as the ones known by the trade names Epikote #807, #827, #828, #1001, #1004, #1007 and #1009, manufactured by Yuka Shell Epoxy Co., the ones known by the trade names ERL #2772 and #2774 and EKR 2002, manufactured by Union Carbide Co., the ones known by the trade names Araldite GY-#250, #260, #280, #6071, 6084 and #6099, manufactured by Ciba Geigy Corp., the ones known by the trade names AER #330, #331, #332, #661 and #664, manufactured by Asahi Chemical Industry Co., Ltd. or the ones known by the trade names Epiclon #800, #1000 and #4000, manufactured by Dainippon Ink & Chemicals Inc., (2) a resin synthesized by the reaction of a glycol with epichlorohydrin or methylepichlorohydrin, such as the one known by the trade name DER #736 manufactured by Dow Chemical Co., (3) a resin obtained by reacting a phenol with formaldehyde in the presence of an acidic or alkaline catalyst to obtain a novolak or resol and reacting thus obtained novolak or resol with epichlorohydrin or methylepichlorohydrin, such as the ones known by the trade names DEN #431, #438 and #448, manufactured by Dow Chemical Co. or the ones known by the trade names ECN #1235, #1273, #1280 and #1290, manufactured by Ciba Geigy Corp., (4) a resin synthesized by oxidizing a double bond within a molecule, such as the ones known by the trade name Unox #201, #206, #207, #221 and #289, manufactured by Union Carbide Co., the ones known by the trade names Araldite Gy #175 and #176, manufactured by Ciba Geigy Corp. or the ones known by the trade names Oxilone #2001 and #2002, manufactured by FMC Corp., (5) a resin obtained by reacting a halogenated phenol with epichlorohydrin or methylepichlorohydrin, such as the ones known by the trade names DER #511, #542 and #580, manufactured by Dow Chemical Co. or the ones known by the trade names Araldite #8011 and #8047, manufactured by Ciba Geigy Corp., (6) a resin obtained by reacting epichlorohydrin or methylepichlorohydrin with an addition product of a phenol with ethylene oxide or propylene oxide, such as the one known by the trade names EP #4000 and #4001, manufactured by Asahi Electro-Chemical Co. Ltd., (7) a resin obtained by reacting a carboxylic acid with epichlorohydrin or methylepichlorohydrin, such as the ones known by the trade names AK #737 and #838, manufactured by Nippon Kayaku Kabushiki Kaisha, the ones known by the trade names Showdine #508, #540 and #550, manufactured by Showa Denko K.K. or the ones known by the trade names Epiclon #200, #300, #400 and #500, manufactured by Dainippon Ink & Chemicals Inc. These resins may be used alone or in combination as a mixture.

It should be understood that other epoxy compounds and their derivatives fall within the scope of the present invention so long as they are readily inferred from the above-mentioned compositions. For instance, as such compounds, there may be mentioned polyol-type epoxy resins, cyclic epoxy resins and halogen-containing epoxy resins. Further, in order to improve the workability, the coating properties or the coating condition, it is possible to incorporate a monoepoxy compound having only one epoxy group to the above-mentioned epoxy resin in an amount of upto 20% by weight relative to the above-mentioned epoxy resin. As such an additional monoepoxy compound, there may be mentioned, for instance, allylglycidyl ether, 2-ethylhexylglycidyl ether, methylglycidyl ether, butylglycidyl ether, phenylglycidyl ether, styreneoxide, cyclohexeneoxide and epichlorohydrin. Further, in addition to the above, there may be incorporated a petroleum resin, a melamine resin, a urea resin, a phenol resin, a hydrocarbon resin (e.g. polybutadiene), an alkyd resin, a polyester resin, maleic oil, urethane oil, coal tar or asphalt.

As the curing agent for the above-mentioned epoxy resin, amino-type compound such as an amine adduct, a polyamide, a polyamine may be used alone or in combination as a mixture. For the crosslinking reaction with the above-mentioned epoxy resin, these amino-type compounds must contain at least two nitrogen atoms per molecule and functional hydrogen atoms attached to the nitrogen atoms.

As the amino-type curing agent to be used in the present invention, there may be mentioned commercially available polyamide resins such as those known by the trade names Tohmide Y-25, Y-245, Y-2400 and Y-2500, manufactured by Fuji Chemical Industry Co., ltd., those known by the trade names Genamid 2000, Versamid 115 and 125, and DSX-1280, manufactured by Dai-Ichi General Co., ltd., those known by the trade names Sunmide 320 and 330, manufactured by Sanwa Chemical Industry Co., Ltd., and those known by the trade names Epikure 3255 and 4255, manufactured by Yuka Shell Epoxy Co., ltd.; amine adduct resins such as those known by the trade names Tohmide 238, Fujicure #202, and #5000, manufactured by Fuji Chemical Industry Co., Ltd., and those known by the trade names Adeka Hardener EH-212, EH-220, EH-240 and EH-531, manufactured by Asahi Electro-Chemical Co., ltd.; heterocyclic diamine derivatives such as those known by the trade names Epomate B-002, C-002 and S-005, manufactured by Ajinomoto Co., Ltd.; and aliphatic polyamines such as those known by the trade names Sunmide T-100, D-100 and P-100, manufactured by Sanwa Chemical Industry Co., Ltd. These curing agents may be used alone or in combination as a mixture depending upon the particular purpose.

The polyurethane resin coating composition to be used in the present invention is a composition comprising, as the vehicle, a one-pack type, two-pack type or moisture-curable type polyurethane resin which is obtainable from a hydroxyl group-containing compound and an isocyanate group-containing compound, optionally by using a modifying agent.

The one-pack type polyurethane resin may be prepared by reacting a polyhydric alcohol having at least two hydroxyl groups in the molecule, any optional active hydrogen-containing compound such as a phenol-type, alcohol-type, active methylene-type, mercaptan-type, acid amide-type, imide-type, amine-type, imine-type, imidazole-type, urea-type, carbamate-type, oxime-type or sulfite-type compound (which is usually called "a blocking agent"), and an isocyanate group-containing compound by a conventional method.

The two-pack type polyurethane resin is obtainable in the form of a two-pack system composition comprising a polyisocyanate compound having at least two isocyanate groups in the molecule and a compound having at least two active hydrogen groups in the molecule.

The moisture curable type polyurethane resin is obtainable from a polyisocyanate compound having at least two isocyanate groups in the molecule.

In the present invention, such a one-pack type, two-pack type or moisture curable type polyurethane resin may be the one modified in accordance with a conventional method.

As the above-mentioned polyhydric alcohol, there may be mentioned ethylene glycol, propylene glycol, diethylene glycol, butylene glycol, 1,6-hexane diol, neopentyl glycol, hexane triol, trimethylol propane, glycerol, castor oil or pentaerythritol. As the compound having at least two active hydrogen groups, there may be mentioned a polyester, a polyether or a hydroxyl group-containing acrylic resins.

As the above-mentioned polyisocyanate compound, there may be mentioned 2,4-tolylene diisocyanate, 2,6-tolylene 0 diisocyanate, 1,6-hexamethylene diisocyanate, 4,4'-diphenylmethane diisocyanate, trans-cyclobutane-1,2-bismethyl diisocyanate, 1,3-phenylene diisocyanate, isopropylidene-bis(4-phenylisocyanate), bis(4-isocyanatephenyl)sulfone, 4,4'-diphenylether diisocyanate, bisphenylene diisocyanate, 3,3'-dimethyl-4,4'-biphenylene diisocyanate, cyclohexylmethane-4,4'-diisocyanate, xylylene diisocyanate or 2,4-cyclohexylene diisocyanate or a reaction product of an excess of such an isocyanate compound with a polyhydric alcohol. These may be used alone or in combination as a mixture.

As the above-mentioned blocking agent, there may be mentioned phenol, cresol, methanol, cyclohexanol, dimethyl maronate, butylmercaptan, thiophenol, acetanilide, acetanisidide, succinic acid imide, diphenyl amine, 2-ethylimidazole, urea, thiourea, phenyl N-phenylcarbamate, ethylene imine, formaldoxime, methyl ethyl ketoxime and sodium bisulfite.

The above-mentioned chlorinated rubber coating composition to be used in the present invention is a composition which comprises, as the major vehicle, a chlorinated rubber such as the one known by the trade name Superchlon CR 10 or CR 20 commercially available from Sanyo Kokusaku Pulp K.K. The chlorinated rubber is usually employed in combination with chlorinated paraffin, an epoxy resin or an alkyd resin.

The above-mentioned vinyl resin coating composition is a composition which comprises, as the vehicle, a resin obtainable by the copolymerization of the following polymerizable monomers.

As such polymerizable monomers, there may be mentioned, for instance, styrene, methylstyrene, chlorostyrene, tert-butylstyrene, methyl (meth)acrylate, ethyl (meth)acrylate, butyl (meth)acrylate, 2-ethylhexyl (meth)acrylate, lauryl (meth)acrylate, β-hydroxyethyl (meth)acrylate, β-hydroxypropyl (meth)acrylate, 4-hydroxybutyl (meth)acrylate, a mono(meth)acrylate of glycerol trimethylolpropane, glycidyl (meth)acrylate, N-butoxymethyl (meth)acrylamide, N-tert-butyl (meth-)acrylamide, dimethylaminoethyl (meth)acrylate, diacetone acrylamide, vinylpyrrolidone, N-methylol acrylamide, acrylamide, (meth)acrylic acid, crotonic acid, vinyl acetate, vinyl chloride, (meth)acrylonitrile and ethylene glycol mono(meth)acrylate, or derivatives thereof. These monomers may be used alone or in combination as a mixture.

When the above-mentioned solvent-type coating composition is used as the primer coating composition in the process of the present invention, at least one of oxyacid salts, metal lead, its oxides and salts, may be used as an anti-corrosive agent, as the case requires.

As the oxyacid salts, there may be employed various salts composed of various metals and oxyacids such as chromic acid, phosphoric acid (including condensed phosphoric acids), boric acid, molybdic acid, phosphomolybdic acid, silicomolybdic acid, tungstic acid, phosphotungstic acid, silicotungstic acid and sulfuric acid. More specifically, there may be mentioned strontium chromate, calcium chromate, lead chromate, zinc chromate, zinc molybdate, calcium molybdate, pottasium molybdate, zinc tungstate, calcium tungstate, magnesium tungstate, zinc phosphate, lead orthophosphate, lead pyrophosphate, lead metaphosphate, aluminum phosphate, tin orthophosphate, tin pyrophosphate, tin oxyphosphate, zinc tetraborate, zinc metaborate, lead metaborate, lead tetraborate, barium metaborate, lead sulfate and lead (IV) sulfate.

As the above-mentioned component of metal lead and its oxides or salts, there may be mentioned, as the representative examples, metal lead, lead suboxide, lead monoxide, lead dioxide, trilead tetraoxide, white lead, lead cyanamide, calcium plumbate, basic lead sulfate and basic lead chromate.

To the above-mentioned various vehicles to be used in the present invention, there may be incorporated, as the case requires, a filler pigment such as talc, barium sulfate, calcium carbonate or barite powder; a coloring pigment such as titanium oxide, zinc white, iron oxide red, scaly iron oxide, chrome yellow, chromium oxide, ultramarine blue, phthalocyanine blue, carbon black or iron black; metal powder such as aluminum or zinc powder; a reinforcing pigment such as glass fiber, glass flakes, mica powder, asbestos or synthetic silica; and an anti-corrosive pigment, as well as a thickener, an anti-corrosive agent, an anti-foaming agent, an anti-settling agent, a curing accelerator, a chelate-reaction accelerator and an adjuvant resin.

Now, the present invention will be described more specifically from the aspect of the process.

According to the process of the present invention, firstly the above-mentioned solvent-type primer coating composition is applied to a substrate with its surface preliminarily cleaned or coated with a shop primer. Then, the applied coating composition is dried at room temperature or by an accelerated drying operation. For the application of the coating composition, a conventional method such as brush coating, spray coating or air-less spray coating may be employed. The dried coating film of the prime coat should preferably have a thickness of from about 30 to about 200 μm.

On the other hand, as the above-mentioned radical-polymerizable and oxidation-polymerizable, room temperature curing type solventless coating composition containing a scaly pigment to be used as the intermediate coating composition in the process of the present invention, it is most preferred to employ a composition which is composed essentially of:

(I) from 30 to 90% by weight of a resin component comprising (A) from 30 to 70% by weight of an oil-modified alkyd resin having an oil length of from 30 to 70% and modified with an α,β-unsaturated monocarboxylic acid selected from the group consisting of sorbic acid, crotonic acid and 2-(β-furyl)acrylic acid, the content of the α,β-unsaturated monocarboxylic acid in the alkyd resin being from 0.5 to 30% by weight, and (B) from 70 to 30% by weight of a polymerizable monomer in which the ingredient (A) is dissolved;

(II) from 70 to 10% by weight of a scaly pigment; and (III) an effective amount of a curing catalyst.

Such a composition is curable by room temperature drying or accelerated drying to give a coating film which is superior not only in the moisture resistance, water resistance and corrosion resistance but also in the surface smoothness, hardness, bending resistance and impact resistance.

Ingredient (A): oil-modified alkyd resin modified with an unsaturated carboxylic acid The ingredient (A) as set forth above is substantially the same as oil-modified alkyd resins which are known heretofore or may be provided in the future except that it has been modified with a specific α,β-unsaturated monocarboxylic acid. The method by which this modification with the α,β-unsaturated monocarboxylic acid is carried out is also the same as the ordinary method of modifying an alkyd resin with a fatty acid.

Accordingly, examples of the polybasic acid of the alkyd resins are aromatic, aliphatic or alicyclic saturated polybasic acids such as phthalic anhydride, isophthalic acid, tetrahydrophthalic anhydride, adipic acid, sebacic acid, azelaic acid, branched 1,2,3,6-tetrahydrophthalic anhydride derivatives which are Diels-Adler adducts of an isoprene dimer having conjugated double bonds and maleic anhydride such as maleinated myrcene, maleinated alloocimene, maleinated ocimene, 3-(β-methyl-2-butenyl)-5-methyl-1,2,3,6-tetrahydrophthalic acid or anhydride thereof, hexahydrophthalic anhydride, 4-methyl-tetrahydrophthalic anhydride, trimellitic acid, and mixtures of two or more of these acids.

Within limits wherein gelation will not occur, a part of given saturated polybasic acid such as the one mentioned above may be substituted by an unsaturated polybasic acid such as, for example, maleic acid, maleic anhydride, fumaric acid, and itaconic acid. Of these, a particularly preferable polybasic acid is a combination of phthalic acid and 3-(β-methyl-2-butenyl)-5-methyl-1,2,3,6-tetrahydrophthalic anhydride (hereinafter referred to by the abbreviation MBTHP). When MBTHP is used in the polybasic acid, it has a remarkable effect in lowering the viscosity of the alkyd resin.

Examples of polyhydric alcohols which can be used for the polyhydric alcohol ingredient are ethylene glycol, diethylene glycol, propylene glycol, dipropylene glycol, 1,4-butanediol, neopentyl glycol, glycerol, pentaerythritol, trimethylol propane, trimethylolethane, tris(2-hydroxyethyl)isocyanurate, and mixtures of two or more of these alcohols. In general, dihydric, trihydric and tetrahydric alcohols of from 2 to 12 carbon atoms are usually preferable.

For the fat, oil, or fatty acid for forming the oil-modified alkyd resin, those which can be dried in air are used, examples being oils and fats such as linseed oil, soybean oil, tall oil, and safflower oil, dehydrated castor oil or fatty acids separated from these oils. Particularly desirable fatty acids are dehydrated castor oil fatty acid and safflower oil fatty acid containing more than 60 mole percent in the fatty acid moiety of linoleic acid and linolenic acid independently or as a mixture system.

According to this invention, the oil-modified alkyd resin comprising the above described three indispensable ingredients is further modified with an $\alpha,\beta$-unsaturated monocarboxylic acid. $\alpha,\beta$-Unsaturated monocarboxylic acids which are suitable for use in this invention are crotonic acid, sorbic acid, and 2-($\beta$-furtyl) acrylic acid, as mentioned hereinbefore, sorbic acid being particularly preferable. Since this acid undergoes radical copolymerization with the ingredient (B) in the composition of this invention and thereby contributes to hardening of the formed film, it is highly effective particularly for improving the hardness and the water resistance of the formed coating film.

Of these four indispensable ingredients, the oil-modified alkyd resin is prepared by an ordinary process.

Specific examples are the process wherein the $\alpha,\beta$-unsaturated monocarboxylic acid, the fatty acid, the polybasic acid, and the polyhydric alcohol are simultaneously charged into the reaction system and caused to react, and the process in which the fatty acid, the polybasic acid, and the polyhydric alcohol are first caused to react, and then the $\alpha,\beta$-unsaturated monocarboxylic acid is caused to react with these reactants. The latter process is desirable on the point of preventing gelation during this preparation process. Furthermore, whatever method is used, it is desirable that an agent for preventing gelation such as hydroquinone, for example, be added in order to prevent gelation during reaction.

An oil-modified alkyd resin suitable for use in this invention has an oil length of 30 to 70%, preferably 55 to 65%. We have found that if the oil length is less than 30%, it will give rise to a lowering of resistance such as water resistance of the formed coating film. On the other hand, if this oil length is higher than 70%, it gives rise to undesirable results such as a lowering the hardness of the formed film at the initial stage of drying and a deterioration of the surface smoothness.

The content of the $\alpha,\beta$-unsaturated monocarboxylic acid in the oil-modified alkyd resin which has been modified with the $\alpha,\beta$-unsaturated monocarboxylic acid is 0.5 to 30% by weight, preferably 2 to 15% by weight. We have found that if this content is less than 0.5%, there will be no appreciable effect in improving the water resistance and hardness of the formed coating film. On the other hand, if this content exceeds 30%, gelation will very readily occur during the alkyd preparation, which will thereby become difficult.

The acid value of the oil-modified alkyd resin modified with the $\alpha,\beta$-unsaturated monocarboxylic acid which is used in this invention is ordinarily of the order of 15 to 40, and the hydroxyl value is ordinarily from 20 to 150.

Ingredient (B): polymerizable monomer

For this monomer, it is possible to use any monomer which is capable of undergoing radical polymerization, has at least one ethylenically unsaturated bond, and is capable of dissolving the above described ingredient (A) to a desired concentration as described in detail hereinafter. However, since it is desired to provide a resin composition which can be hardened at room temperature, a polymerizable monomer of high boiling point of an order exceeding 200° C. is especially preferable.

Specific examples of polymerizable monomers suitable for use as the ingredient (B) in this invention are as set forth below. These monomers can be used in combination as a mixture.

Monoacrylates and monomethacrylates of monohydric or polyhydric alcohols having 2 to 20, preferably 2 to 18 carbon atoms, preferably monoacrylates and monomethacrylates of monohydric and dihydric alcohols.

Specific examples of these monoacrylates and monomethacrylates are as set forth below. In the following list, the term "(meth)acrylate" means acrylate and methacrylate: 2-hydroxyethyl (meth)acrylate, 2-hydroxypropyl (meth)acrylate, 2-hydroxyethoxyethyl (meth)acrylate, 4-hydroxybutyl (meth)acrylate, 5-hydroxypentyl (meth)acrylate, 6-hydroxyhexyl (meth-)acrylate, neopentylglycol mono(meth)acrylate, 3-butoxy-2-hydroxypropyl (meth)acrylate, 2-hydroxy-1- or -2-phenylethyl (meth)acrylate, polypropylene glycol mono(meth)acrylate, glycerine mono(meth)acrylate monohalfmaleate, diethyleneglycol mono(meth)acrylate, cyclohexyl (meth)acrylate, benzyl (meth)acrylate, 2-ethoxyethyl (meth)acrylate, 2-butoxyethyl (meth)acrylate, and tetrahydrofuryl (meth)acrylate.

Examples are di-, tri-, and tetra-esters of alcohols each having at least two hydroxyl groups and having 2 to 20 carbon atoms, preferably 2 to 6 carbon atoms, preferably dihydric, trihydric, and tetrahydric alcohols and acrylic acid and methacrylic acid.

Specific examples of these di-, tri-, and tetra-acrylates and methacrylates are: ethyleneglycol di(meth)acrylate, diethyleneglycol di(meth)acrylate, 1,4-butanediol di(-meth)acrylate, 1,6-hexanediol di(meth)acrylate, neopentylglycol di(meth)acrylate, trimethylolpropane tri(-metha)acrylate, pentacrythritol tri(meth)acrylate, pentacrythritol tetra(meth)acrylate, and glycerine monoacrylate monomethacrylate. It is possible to use any monomer having a relatively low boiling point, for example, styrene, methylmethacrylate and divinyl benzene.

Examples of particularly suitable polymerizable monomers for the ingredient (B) of this invention are: tetrahydrofurfuryl acrylate, 2-hydroxyethyl methacrylate, 2-hydroxypropyl acrylate, 3-butoxy-2-hydroxypropyl acrylate, 1,4-butanediol diacrylate, 1,6-hexanediol diacrylate, and trimethylolpropane tri(meth)acrylate. The solventless coating composition according to this invention contains the above described indispensable two ingredients (A) and (B) in a specific ratio.

The quantity of the ingredient (A) is from 30 to 70% by weight, preferably 40 to 60% by weight, of the total weight of these two ingredients (A) and (B). If this quantity exceeds 70%, the resin composition will acquire a remarkably high viscosity, and its preparation and utilization, for example, as a coating composition, will become difficult. On the other hand if this quantity is less than 30%, the water resistance, impact resistance, and bending resistance of the formed coating film will deteriorate.

The quantity of the ingredient (A) is from 30 to 70% by weight, preferably 40 to 60% by weight, of the total weight of these two ingredients (A) and (B).

As the above-mentioned scaly pigment to be used for the intermediate coating composition of the present invention, there may be mentioned pigments such as micaceous iron oxide (i.e. the above-mentioned MIO), glass flakes, aluminum powder, talc and mica. These scaly pigments may be used alone or in combination as a mixture.

Particularly preferred as the intermediate coating composition of the present invention is a composition which comprises from 30 to 90% by weight of the above-mentioned resin component composed of a mixture of the above-mentioned oil-modified alkyd resin and the polymerizable monomer, and from 70 to 10% by weight of the scaly pigment. If the amount of the scaly pigment is less than the lower limit of the above range, the effect intended by the present invention tends to decrease. On the other hand, if the amount exceeds the upper limit, the surface smoothness of the formed coating film tends to be inferior.

Further, to the above-mentioned coating composition, there may be incorporated, as the case requires, various additives e.g. a coloring pigment such as titanium oxide, carbon black, iron oxide or ultramarine blue; a filler pigment such as talc, zinc white or barium sulfate; an anti-corrosive pigment such as minium, zinc powder or zinc chromate; a coating film surface improver such as polyethylene glycol; a filler; a stabilizer; a pigment disperser; and a thixotropic agent.

The solventless type coating composition of this invention can be cured by using a curing catalyst, that is, a redox catalyst comprising an organic peroxide and a reducing agent and used, if necessary, in conjunction with a drier(metallic soap) such as manganese naphthenate or cobalt naphthenate. Examples of curing catalysts are:

(a) A combination of methyl ethyl ketone peroxide and cobalt naphthenate;
(b) A combination of a redox catalyst comprising benzoyl peroxide and dimethylaniline and cobalt naphthenate or manganese naphthenate; and
(c) A combination of cyclohexanone peroxide and cobalt naphthenate.

Of these curing agents, cobalt naphthenate is particularly suitable because it not only participates as a reducing agent in radical generation but functions also as a drier participating also in the oxidation hardening of the oil-modified alkyd resin.

The above described catalyst is used in proportions of 0.5 to 5 parts by weight of the organic peroxide and of 0.01 to 5 parts by weight of the reducing agent relative to 100 parts by weight of the resin composition comprising (A) and (B).

The process for forming a coating film according to the present invention comprises applying the above-mentioned solvent-type coating composition on a substrate and drying it to form a prime coat, as described above, and then applying the above-mentioned solventless coating composition as the intermediate coating composition on the prime coat by a conventional coating method such as brush coating, spray coating or air-less spray coating so that the thickness of the dried coating film becomes to be within a range of from 30 to 500 μm, preferably from 40 to 350 μm, followed by drying.

Thus, the solventless coating composition is cured by radical polymerization and oxidation polymerization during the drying step, to form a coating film.

According to the process of the present invention, onto the intermediate coating film thus formed, an air-drying type finish coating composition is further applied.

As such a finish coating composition, it is preferred to use (a) an air-drying solvent-type coating composition or (b) a radical-polymerizable and oxidation-polyemrizable, room temperature curing type solventless coating composition.

As the air-drying solvent-type coating composition (a), there may be mentioned a chlorinated rubber coating composition, a polyurethane resin coating composition, an epoxy resin coating composition, a vinyl resin coating composition, an oil-type coating composition and an alkyd resin coating composition. The vehicle to be used for these solvent-type coating compositions may be of the same type as used for the above-mentioned primer coating compostion.

As the above-mentioned radical-polymerizable and oxidation-polyemrizable, room temperature curing type solventless coating composition for the finish coating, there may be mentioned a composition which is composed essentially of a resin component comprising (A) from 30 to 70% by weight of an oil-modified alkyd resin having an oil length of from 30 to 70% and modified with an α,β-unsaturated monocarboxylic acid selected form the gorup consisting of sorbic acid, crotonic acid and 2-(β-furyl) acrylic acid, the content of the α,β-unsaturated mono-carboxylic acid in the alkyd resin being from 0.5 to 30% by weight, and (B) from 70 to 30% by weight of a polymerizable monomer in which the ingredient (A) is dissolved, and (C) a curing catalyst. The above ingredients (A), (B) and (C) may be of the same types as described with respect to the above-mentioned intermediate coating composition.

To the composition (a) or (b) as the finish coating composition, the above-mentioned coloring pigment, filler pigment and other additives may be incorporated as the case requires.

Among the above-mentioned finish coating compositions, the room temperature curing type solventless coating composition is preferred from the viewpoints of environmental hygiene, the capability of forming a thick coating film and the weather resistance, water resistance and moisture resistance of the coating film.

In the process of the present invention, the air-drying type finish coating composition is applied on the intermediate coat by a conventional method such as brush coating, air spray coating or air-less spray coating so that the thickness of the dried coating film becomes to be from about 30 to 300 μm, followed by room temperature drying (curing) for finishing.

Thus, according to the process of the present invention, the following advantages may be obtained.

(1) It is possible to form a coating film which is superior in the interlayer adhesion and in the the corrosion resistance and which is free from the formation of blisters.

(2) It is possible to obtain a coating film which is superior in the moisture resistance, water resistance and rust-preventive property.

(3) The combination of the primer coating composition and the finish coating composition may be optionally selected. Accordingly, a wide range of coating systems may be obtained.

(4) The oxygen permeability of the coating film is minimum. For instance, the oxygen permeability of the intermediate coating film of the present invention is about 1/10 of that of a chlorinated rubber coating film.

(5) The intermediate coating composition is a solventless coating composition, whereby a high-build coating i.e. a thick coating, is possible.

Thus, the process of the present invention has a significant industrial value in that it provides various advantages as mentioned above.

Now, the present invention will be described in detail with reference to Examples. However, it should be understood that the present invention is by no means restricted by these specific Examples. In the Examples, "parts" and "%" are meant for "parts by weight" and "% by weight", respectively.

(I) PREPARATION OF SOLVENT-TYPE PRIMER COATING COMPOSITIONS

(i) Oil-type coating composition (A) for primer coating

To 34.0 parts of boiled linseed oil, 6.0 parts of an iron oxide red coloring pigment, 52.3 parts of calcium carbonate, 4.0 parts of mineral spirit, 0.2 part of an anti-skinning agent, 2.5 parts of a drier and 1.0 part of a thixotropic agent were added, and the mixture was kneaded by rollers. Prior to use, 23.5 parts of lead suboxide was mixed thereto to obtain an oil-type coating composition (A).

(ii) Solvent-type alkyd resin coating composition (B) for primer coating 35.0 Parts of a soybean oil-modified alkyd resin (oil length: 65%, non-volatile component: 70%, viscosity at 20° C.: 55 stokes' poise), 5.0 parts of a linseed oil/-soybean oil type boiled oil, 13.0 parts of an iron oxide red coloring pigment, 43.5 parts of calcium carbonate, 0.2 part of an anti-skinning agent, 1.0 part of a thixotropic agent and 2.5 parts of a mixed drier were kneaded by rollers. Prior to use, 26.6 parts of lead suboxide powder was added thereto to obtain a solvent-type alkyd resin coating composition (B).

(iii) Solvent-type epoxy resin coating composition (C) for primer coating (Main component)

30.0 Parts of a xylene solution containing 70% of a solid bisphenol A type epoxy resin (epoxy equivalent: 450–500), 3.0 parts of a liquid bisphenol A type epoxy resin (epoxy equivalent: 230–270), 40.0 parts of talc, 5.0 parts of an iron oxide red coloring pigment, 1.0 part of thixotropic agent, 10.0 parts of xylene, 10.0 parts of cellosolve and 1.0 part of an additive were kneaded by rollers to obtain a main component.

(Curing agent)

50.0 Parts of a modified heterocyclic polyamine (amine value: 87 mgKOH/g) was dissolved in 50 parts of xylene to obtain a curing agent. Prior to use, the main component and the curing agent were mixed in a weight ratio of 80:20 to obtain a solvent-type epoxy resin coating composition (C).

(iv) Solvent-type polyurethane resin coating composition (D) for primer coating (Main component)

5.0 Parts of castor oil, 1.0 part of trimethylolpropane, 30.0 parts of a hydroxyl group-containing solid bisphenol type epoxy resin solution (epoxy equivalent: 450–500, 70% xylene solution), 6.0 parts of methyl isobutyl ketone, 45.0 parts of talc, 5.0 parts of an iron oxide red coloring pigment, 2.4 parts of a thixotropic agent and 5.6 parts of xylene were kneaded by rollers to obtain a main component.

(Curing agent)

50 Parts of a 4,4'-diphenylmethane diisocyanate solution (NCO content: 31%) was mixed with 50 parts of methyl isobutyl ketone to obtain a curing agent.

Prior to use, the above-mentioned main component and the curing agent were mixed in a weight ratio of 80:20 to obtain a solvent-type polyurethane resin coating composition (D).

(v) Solvent-type chlorinated rubber cotaing composition (E) for primer coating 10.0 Parts of chlorinated rubber (CR-10 manufactured by Sanyo Kokusaku Pulp K.K.), 4.0 parts of chlorinated paraffin, 6.0 parts of a modified alkyd resin solution (oil length: 50%, non-valatile component: 50%), 1.0 part of a thixotropic agent, 9.0 parts of xylene and 70.0 parts of talc were kneaded by rollers to obtain a solvent-type chlorinated rubber coating composition (E).

(vi) Solvent-type vinyl resin composition (F) for primer coating 40.0 Parts of a solution of a vinyl acetate-methacrylic acid ester copolymer in a solvent mixture of methyl isobutyl ketone and xylene (non-volatile component: 50%, viscosity at 20° C.: 25 Stokes' poise), 40 parts of talc, 2.0 parts of a thixotropic agent, 8.0 parts of methyl isobutyl ketone, 8.0 parts of xylene and 2.0 parts of an additive were kneaded by rollers to obtain a solvent-type vinyl resin coating composition (F).

(II) PREPARATION OF RADICAL POLYMERIZABLE AND OXIDATION-POLYMERIZABLE, ROOM TEMPERATURE CURING TYPE SOLVENTLESS COATING COMPOSITIONS FOR INTERMEDIATE COATING

(i) Solventless coating composition (A) for intermediate coating

Into a four-necked flask equipped with a stirrer, a water separator, a condenser and a nitrogen gas supply tube, 52.9 parts of soybean oil fatty acid, 14.9 parts of phthalic anhydride, 11.7 parts of MBTHP, 5.5 parts of glycerol and 15.1 parts of pentaerythritol were fed, and 0.1 part of hydroquinone and 4.0 parts of xylene were further added. Then, the mixture was reacted in a nitrogen gas stream at 220° C.

When the acid value of the formed alkyd reached 40, 7.1 parts of sorbic acid and 0.2 part of hydroquinone were added, and the reaction was continued until the acid value reached 20, whereby an oil-modified alkyd resin having a sorbic acid content of 7.1% and an oil length of 5.3% was obtained.

To 55.0 parts of the oil-modified alkyd resin, 10.0 parts of 2-hydroxypropyl acrylate and 35.0 parts of 1,4-butanediol diacrylate were added and stirred to obtain a resin composition (I) having a viscosity of 1.6 poise (25° C.). 98.0 Parts of this resin composition (I), 0.98 part of cobalt naphthenate (metal content: 6%), 0.15 part of methyl ethyl ketone oxime, 0.001 part of a silicone-type anti-foaming agent and 0.4 part of an asbestos-type thixotropic agent were mixed. Immediately prior to use, 1.7 parts of methyl ethyl ketone peroxide and 66.4 parts of an aluminum paste were added to obtain a solventless coating composition (A).

(ii) Solventless coating composition (B) for intermediate coating

The reaction was conducted in the same manner as in the case of the above resin composition (I) except that 56.5 parts of dehydrated castor oil fatty acid, 15.0 parts of phthalic anhydride, 11.9 parts of MBTHP, 6.7 parts of glycerol, 13.5 parts of pentaerythritol and 3.5 parts of crotonic acid were used, whereby an oil-modified alkyd resin having a crotonic acid content of 3.5% and an oil length of 59.0% was obtained.

To 55.0 parts of the oil-modified alkyd resin, 10.0 parts of 2-hydroxypropyl acrylate and 35.0 parts of 1,4-butanediol diacrylate were added, stirred and dissolved to obtain a solventless resin composition (II) having a viscosity of 2.3 poise (25° C.)

25.0 Parts of the solventless resin composition (II), 0.25 part of cobalt nephthenate (metal content: 6%), 4.0 parts of talc, 0.4 part of methyl ethyl ketone oxime, 0.001 part of a silicone-type antifoaming agent and 0.8 part of an organic thixotropic agent were kneaded by rollers, and then 70.0 parts of MIO was added thereto and mixed. Immediately prior to use, 1.0 part of methyl ethyl ketone peroxide was added thereto to obtain a solventless coating composition (B).

(iii) Solventless coating composition (C) for intermediate coating

The reaction was conducted in the same manner as in the case of the above resin composition (I) except that 54.6 parts of dehydrated castor oil fatty acid, 15.1 parts of phthalic anhydride, 12.0 parts of MBTHP, 7.7 parts of glycerol, 12.1 parts of pentaerythritol and 5.4 parts of 2-(β-furyl)acrylic acid were used, whereby an oil-modified alkyd resin having an acid value of 20, a 2-(β-furyl-)acrylic acid content of 5.4% and an oil length of 57.1% was obtained.

To 55 parts of the oil-modified alkyd resin, 10.0 parts of 2-hydroxypropyl acrylate and 35.0 parts of 1,4-butanediol diacrylate were added, stirred and dissolved to obtain a solventless resin composition (III) having a viscosity of 2.5 poise (25° C.).

To 75.0 parts of the solventless resin composition (III), 4.0 parts of titanium oxide, 0.9 part of cobalt naphthenate, 0.1 part of methyl ethyl ketone oxime, 0.5 part of a silane coupling agent (trade name KBM 503 manufactured by Shin-Etsu Chemical Co., Ltd.), 0.001 part of a silicone-type anti-foaming agent and 0.5 part of an organic thixotropic agent were added and kneaded by rollers, and then 23.0 parts of glass flakes (150 mesh) were added thereto and mixed. Prior to use, 1 part of methyl ethyl ketone peroxide was added thereto to obtain a solventless coating composition (C).

(III) PREPARATION OF COMPARATIVE INTERMEDIATE COATING COMPOSITIONS (i) Comparative intermediate coating composition (D)

30.0 Parts of commercially available acryl modified alkyd resin type non-aqueous dispersion (non-volatile component: 50%, viscosity guardner Z), 10.0 parts of talc, 9.0 parts of mineral spirit, 0.4 part of an organic thixotropic agent, 0.2 part of methyl ethyl ketone oxime and 0.6 part of cobalt naphthenate (metal content: 5%) were kneaded by rollers, and then 50.0 parts of MIO and 3.0 parts of mineral spirit were added thereto and mixed to obtain a comparative intermediate coating composition (D).

(ii) Comparative intermediate coating composition (E)

25.0 Parts of a xylene solution containing 70% of a solid bisphenol A type epoxy resin (epoxy equivalent: 450-500), 16.0 parts of talc, 3.0 parts of iron oxide red, 1.0 part of an organic thixotropic agent, 13 parts of xylene, 5 parts of ethyl cellosolve and 3.0 parts of methyl isobutyl ketone were kneaded by rollers, and then 4.5 parts of MIO was added thereto and stirred to obtain a main component.

On the other hand, 70 parts of a modified heterocyclic polyamine (solid content: 65%, amine value: 165) was dissolved in 30 parts of xylene to obtain a curing agent.

Prior to use, the main component and the curing agent were mixed in a weight ratio of 90:10 to obtain a comparative intermediate coating composition (E).

(IV) PREPARATION OF SOLVENT-TYPE FINISH COATING COMPOSITIONS (i) Alkyd resin coating composition (A) for finish coating 40.0 parts of a mineral spirit solution of a soybean oil modified alkyd resin (oil length: 60%, non-volatile component: 70%), 25.0 parts of titanium oxide, 25 parts of barium sulfate, 0.4 part of an anti-skinning agent, 2.0 parts of a mixed drier, 1.3 parts of an additive and 6.3 parts of mineral spirit were kneaded by rollers to obtain a finish coating composition (A).

(ii) Epoxy resin coating composition (B) for finish coating (Main component)

28.0 Parts of a bisphenol A type epoxy resin (epoxy equivalent: 450–500), 12 parts of xylene, 30.0 parts of talc, 10.0 parts of barium sulfate, 5.5 parts of titanium oxide, 10.0 parts of ethyl cellosolve and 1.5 parts of a thixotropic agent and a leveling agent were kneaded by rollers to obtain a main component.

(Curing agent)

70 Parts of a modified heterocyclic polyamine (solid component: 65%, amine value: 165) was dissolved in 30 parts of xylene to obtain a curing agent.

Prior to use, the above-mentioned main component and the curing agent were mixed in a weight ratio of 87:13 to obtain a finish coating composition (B).

(iii) Polyurethane resin coating composition (C) for finish coating (Main component)

30.0 Parts of an acrylpolyol solution (a xylene solution having a solid content of 50%, hydroxyl value: 50, acid value: 1.0), 25.0 parts of xylene, 5.0 parts of butyl acetate, 20.0 parts of titanium oxide, 15.0 parts of talc and 5.0 parts of an additive were kneaded by rollers to obtain a main component.

(Curing agent)

80.0 Parts of an aliphatic isocyanate compound (solid component: 75%, NCO content: 16%) was dissolved in 20.0 parts of butyl acetate to obtain a curing agent.

Immediately prior to use, the above-mentioned main component and the curing agent were mixed in a weight ratio of 85:15 to obtain a finish coating composition (C).

(iv) Chlorinated rubber coating composition (D) for finish coating

To 10.0 parts of chlorinated rubber (chlorine content: 65%), 12.0 parts of an alkyd resin, 15.0 parts of chlorinated paraffin, 20.5 parts of xylene, 15.0 parts of talc, 20.0 parts of titanium oxide and 4.5 parts of an additive were added, and the mixture was kneaded by rollers to obtain a finish coating composition (D).

(v) Vinyl resin coating composition (E) for finish coating 40.0 Parts of a solution of a vinyl acetate-methacrylic acid ester copolyemr in a solvent mixture of methyl isobutyl ketone and xylene (the same as used in primer coating composition F), 20.0 parts of titanium oxide, 25.0 parts of barium sulfate, 1.5 parts of a thixotropic agent, 7.0 parts of methyl isobutyl ketone, 7.0 parts of xylene and 1.0 part of an additive were kneaded by rollers to obtain a finish coating composition (E).

(V) PREPARATION OF SOLVENTLESS COATING COMPOSITION FOR FINISH COATING (i) Solventless coating composition (A) for finish coating Into a four-necked flask equipped with a stirrer, a water separator, a condenser and a nitrogen gas supply tube, 52.9 parts of soybean oil fatty acid, 14.9 parts of phthalic anhydride, 11.7 parts of MBTHP, 5.5 parts of glycerol and 15.1 parts of pentaerythritol were fed, and 4.0 parts of xylene was further added. The mxiture was reacted in a nitrogen gas stream at 220° C.

When the acid value of the formed alkyd resin reached 40, 7.1 parts of sorbic acid and 0.2 part of hydroquinone were added, and the reaction was continued until the acid value reached 20, whereby an oil-modified alkyd resin (b) having a sorbic acid content of 7.1% and an oil length of 55.3% was obtained.

To 55.0 parts of the oil-modified alkyd resin (b), 10.0 parts of 2-hydroxypropyl acrylate and 35.0 parts of 1,4-butanediol diacrylate were added and stirred to obtain a resin composition having a viscosity of 1.6 poise (25° C.). To 65.0 parts of this composition, 10.0 parts of barium sulfate, 5.0 parts of talc and 20.0 parts of titanium oxide were mixed, and 0.001 part of a silicone-type anti-foaming agent, 0.4 part of an asbestos-type thixotropic agent, 0.65 part of cobalt naphthenate (metal content: 6%) and 0.12 part of methyl ethyl ketone oxime for preventing skinning and for the control of pot life, were further added thereto. The mixture was kneaded by rollers. Prior to use, 1 part of methyl ethyl ketone peroxide was added to obtain a solventless finish coating composition (A).

(ii) Solventless coating composition (B) for finish coating

The reaction was conducted in the same manner as in the case of the alkyd resin (b) except that 56.5 parts of dehydrated castor oil fatty acid, 15.0 parts of phthalic anhydride, 11.9 parts of MBTHP, 6.7 parts of glycerol, 13.5 parts of pentaerythritol and 3.5 parts of crotonic acid were used, whereby an oil-modified alkyd resin having a crotonic acid content of 3.5% and an oil length of 59.0% was obtained.

To 55.0 parts of the oil-modified alkyd resin, 10.0 parts of 2-hydroxypropyl acrylate and 35.0 parts of 1,4-butanediol diacrylate were added, stirred and dissolved to obtain a solventless resin composition having a viscosity of 2.3 poise (25° C.). To 65 parts of this composition, 3.0 parts of talc, 10.0 parts of barium sulfate, 3.0 parts of calcium carbonate, 20.0 parts of titanium oxide, 0.65 part of cobalt naphthenate (metal content: 6%), 0.11 part of methy ethyl ketone oxime, 0.001 part of a silicone-type anti-foaming agent and 0.4 part of an asbestos-type thixotropic agent were added, and the mixture was kneaded by rollers. Prior to use, 1.5 part of methyl ethyl ketone peroxide was added thereto to obtain a solventless finish coating composition (B).

(iii) Solventless coating composition (C) for finish coating

The reaction was conducted in the same manner as in the case of alkyd resin (b) except that 54.6 parts of dehydrated castor oil fatty acid, 15.1 parts of phthalic anhydride, 12.0 parts of MBTHP, 7.7 parts of glycerol, 12.1 parts of pentaerythritol and 5.4 parts of 2-(β-furyl) acrylic acid were used, whereby an oil-modified alkyd resin having an acid value of 20, a 2-(β-furyl)-acrylic acid content of 5.4% and an oil length of 57.1% was obtained.

To 55 parts of the oil-modified alkyd resin, 10.0 parts of 2-hydroxypropyl acrylate and 35.0 parts of 1,4-butanediol diacrylate were added, stirred and dissolved to obtain a solventless resin composition having a viscosity of 2.5 poise (25° C.). To 65 parts of this composition, 10.0 parts of talc, 5.0 parts of barium sulfate, 20.0 parts of titanium oxide, 0.7 part of cobalt naphthenate (metal content: 6%), 0.09 part of methyl ethyl ketone oxime, 0.001 part of a silicone-type anti-foaming agent and 0.3 part of an asbestos-type thixotropic agent were added, and the mixture was kneaded by rollers. Prior to use, 1 part of methyl ethyl ketone peroxide was added thereto to obtain a solventless finish coating composition (C).

(VI) PREPARATION OF COMPARATIVE FINISH COATING COMPOSITIONS (i) Comparative finish coating composition (D)

40.0 Parts of a mineral spirit solution of a soybean oil modified alkyd resin (oil length: 60%, non-volatile component: 70%), 25.0 parts of titanium oxide, 25 parts of barium sulfate, 0.4 part of an anti-skinning agent, 2.0 parts of a mixed drier, 1.3 parts of an additive and 6.3 parts of mineral spirit were kneaded by rollers to obtain a comparative finish coating composition (D).

(ii) Comparative finish coating composition (E)

(Main component)

28.0 Parts of a bisphenol A type epoxy resin (epoxy equivalent: 450–500), 12 parts of xylene, 30.0 parts of talc, 10.0 parts of barium sulfate, 5.5 parts of titanium oxide, 10.0 parts of ethyl cellosolve and 1.5 parts of a thixotropic agent and a leveling agent were kneaded by rollers to obtain a main component.

(Curing agent)

70 Parts of a modified heterocyclic polyamine (solid component: 65%, amine value: 165) was dissolved in 30 parts of xylene to obtain a curing agent.

Prior to use, the above-mentioned main component and the curing agent were mixed in a weight ratio of 87:13 to obtain a comparative finish coating composition (E).

EXAMPLES 1 to 12 and COMPARATIVE EXAMPLES 1 to 10

(1) Preparation of test pieces

The coating systems identified in Tables 1 and 2 were used. The primer coating composition was applied on a sand blasted steel sheet (1.6×70×150 mm) by air spray coating to obtain a dried film having a predetermined thickness, and left to stand at room temperature (20° C.) for 2 days. Then, the intermediate coating composition was applied thereon in the same manner and left to stand at room temperature for 2 days. Thereafter, the finish coating composition was applied in the same manner and left to stand at room temperature for 7 days.

The test pieces thus obtained were subjected to comparative tests. The results are shown in Tables 1 and 2.

(2) Test methods (i) Moisture resistance: the test was conducted at a temperature of 49°±1° C. at a relative humidity of 97%, whereby the time for the formation of blisters was recorded.

(ii) Water resistance: each test piece was immersed completely in pure water at room temperature, whereby the time for the formation of blisters was recorded.

(iii) Corrosion resistance: cross cut lines reaching the substrate were formed on the coated surface of each test piece, and then the test piece was subjected to a salt spray test (JIS K-5400, 7.8), whereby rust formation on the test piece was observed.

It is evident from Tables 1 and 2 that the coating films formed by the process of the present invention are superior in the moisture resistance, water resistance and corrosion resistance, since solventless coating compositions having superior corrosion resistance and minimum oxygen permeability are used as the intermediate coating compositions.

TABLE 1

Coating systems and results of comparative tests

| | Examples | | | | | |
|---|---|---|---|---|---|---|
| | 1 | 2 | 3 | 4 | 5 | 6 |
| Primer coating | | | | | | |
| Type | (A) | (B) | (C) | (D) | (E) | (F) |
| Film thickness | 40 μm | 40 μm | 50 μm | 40 μm | 40 μm | 40 μm |
| Number of coating applications | 2 times | 2 times | 2 times | 2 times | 2 times | 2 times |
| Intermediate coating | | | | | | |
| Type | (A) | (B) | (C) | (A) | (B) | (C) |
| Film thickness | 50 μm | 50μm | 50 μm | 50 μm | 50 μm | 50 μm |
| Number of coating applications | 1 time | 1 time | 1 time | 1 time | 1 time | 1 time |
| Finish coating | | | | | | |
| Type | (A) | (A) | (B) | (C) | (D) | (E) |
| Film Thickness | 30 μm | 30 μm | 50 μm | 30 μm | 35 μm | 50 μm |
| Number of coating applications | 2 times | 2 times | 1 time | 2 times | 2 times | 2 times |
| Total film thickness | 190 μm | 190 μm | 200 μm | 190 μm | 200 μm | 230 μm |
| Film properties | | | | | | |
| Moisture resistance | 100 hr | 150 hr | At least 3500 hr | At least 2500 hr | 500 hr | 550 hr |
| Water resistance | 15 days | 25 days | 80 days | 40 days | 35 days | 35 days |
| Corrosion resistance | | | | | | |
| 300 hr | No change | No change | No change | No change | No change | No change |
| 800 hr | " | " | " | " | " | " |
| 1200 hr | " | " | " | " | " | " |

| | Comparative Examples | | | | | |
|---|---|---|---|---|---|---|
| | 1 | 2 | 3 | 4 | 5 | 6 |
| Primer coating | | | | | | |
| Type | (A) | (B) | (C) | (D) | (E) | (F) |
| Film thickness | 40 μm | 40 μm | 50 μm | 40 μm | 40 μm | 50 μm |
| Number of coating applications | 2 times | 2 times | 2 times | 2 times | 2 times | 2 times |
| Intermediate coating | | | | | | |
| Type | (D) | (D) | (E) | (E) | finish coating (A) | finish coating (B) |
| Film thickness | 50 μm | 50 μm | 50 μm | 50 μm | 40 μm | 50 μm |
| Number of coating applications | 1 time | 1 time | 1 time | 1 time | 1 time | 1 time |
| Finish coating | | | | | | |
| Type | (A) | (A) | (C) | (D) | (A) | (B) |
| Film thickness | 30 μm | 30 μm | 50 μm | 30 μm | 35 μm | 50 μm |
| Number of coating | 2 times | 2 times | 1 time | 2 times | 2 times | 1 time |

TABLE 1-continued

| Coating systems and results of comparative tests | | | | | | |
|---|---|---|---|---|---|---|
| applications | | | | | | |
| Total film thickness | 190 μm | 190 μm | 200 μm | 190 μm | 190 μm | 200 μm |
| Film properties | | | | | | |
| Moisture resistance | 30 hr | 50 hr | 2000 hr | 1500 hr | 40 hr | 1600 hr |
| Water resistance | 10 days | 15 days | 70 days | 35 days | 10 days | 50 days |
| Corrosion resistance | | | | | | |
| 300 hr | Rust formed | Rust formed | No change | Rust slightly formed | Rust substantially formed | No change |
| 800 hr | Rust substantially formed | Rust substantially formed | Rust slightly formed | Rust formed | Rust formed about 50% | Rust slightly formed |
| 1200 hr | Rust formed about 70–80% | Rust formed about 85% | Rust substantially formed | Rust substantially formed | Rust formed about 90% | Rust substantially formed |

TABLE 2

| Coating systems and results of comparative tests | | | | | | |
|---|---|---|---|---|---|---|
| | Examples | | | | | |
| | 7 | 8 | 9 | 10 | 11 | 12 |
| Primer coating | | | | | | |
| Type | (A) | (B) | (C) | (D) | (E) | (F) |
| Film thickness | 40 μm | 40 μm | 50 μm | 40 μm | 40 μm | 40 μm |
| Number of coating applications | 2 times | 2 times | 2 times | 2 times | 2 times | 2 times |
| Intermediat coating | | | | | | |
| Type | (A) | (C) | (C) | (A) | (B) | (C) |
| Film thickness | 50 μm | 50 μm | 50 μm | 50 μm | 50 μm | 50 μm |
| Number of coating applications | 1 time | 1 time | 1 time | 1 time | 1 time | 1 time |
| Finish coating | | | | | | |
| Type | (A) | (B) | (C) | (A) | (B) | (C) |
| Film thickness | 60 μm | 60 μm | 60 μm | 60 μm | 60 μm | 60 μm |
| Number of coating applications | 1 time | 1 time | 1 time | 1 time | 1 time | 1 time |
| Total film thickness | 190 μm | 190 μm | 210 μm | 190 μm | 190 μm | 190 μm |
| Film properties | | | | | | |
| Moisture resistance | 130 hr | 200 hr | At least 4000 hr | At least 3000 hr | 800 hr | 700 hr |
| Water resistance | 20 days | 40 days | 90 days | 45 days | 40 days | 42 days |
| Corrosion resistance | | | | | | |
| 300 hr | No change | No change | No change | No change | No change | No change |
| 800 hr | " | " | " | " | " | " |
| 1200 hr | " | " | " | " | " | " |

| | Comparative Examples | | | |
|---|---|---|---|---|
| | 7 | 8 | 9 | 10 |
| Primer coating | | | | |
| Type | (B) | (B) | (C) | (C) |
| Number of coating applications | 40 μm | 40 μm | 50 μm | 50 μm |
| Intermediate coating | | | | |
| Type | (D) | (D) | (E) | (E) |
| Film thickness | 50 μm | 50 μm | 50 μm | 50 μm |
| Number of coating applications | 1 time | 1 time | 1 time | 1 time |
| Finishing coating | | | | |
| Type | (D) | (A) | (E) | (A) |
| Film thickness | 30 μm | 60 μm | 60 μm | 60 μm |
| Number of coating applications | 2 times | 1 time | 1 time | 1 time |
| Total film thickness | 190 μm | 190 μm | 210 μm | 210 μm |
| Film properties | | | | |
| Moisture resistance | 50 hr | 90 hr | 2000 hr | 2300 hr |
| Water resistance | 20 days | 25 days | 70 days | 75 days |

TABLE 2-continued

| Coating systems and results of comparative tests | | | | |
|---|---|---|---|---|
| Corrosion resistance | | | | |
| 300 hr | Rust formed | Rust slightly formed | No change | No change |
| 800 hr | Rust substantially formed | Rust formed | Rust slightly formed | No change |
| 1200 hr | Rust formed about 85% | Rust formed about 50% | Rust formed | Rust slightly formed |

We claim:

1. A process for forming a moisture resistant coating film, which comprises:

(i) priming a coating composition on a substrate and drying it to form a prime coat;

(ii) coating thereon a radical-polymerizable and oxidation-polymerizable, room temperature solventless coating composition composed essentially of:

A. from 30 to 90% by weight of a resin component comprising (A) from 30 to 70% by weight of an oil-modified alkyd resin having an oil length of from 30 to 70% and modified with an $\alpha,\beta$-unsaturated monocarboxylic acid selected from the group consisting of sorbic acid, crotonic acid and 2-($\beta$-furyl)acrylic acid, the content of the $\alpha,\beta$-unsaturated monocarboxylic acid in the alkyd resin being from 0.5 to 30% by weight, and (B) from 70 to 30% by weight of a polymerizable monomer in which the ingredient (A) is dissolved, B. from 70 to 10% by weight of a scaly pigment, and C. an effective amount of a curing catalyst, and polymerizing it to form a cured intermediate coat; and (iii) coating thereon an air-drying finish coating composition and drying it to form a finish coat.

2. The process according to claim 1, wherein the primer coating composition is selected from the group consisting of an oil-type coating composition, an alkyd resin type coating composition, an epoxy resin type coating composition, a polyurethane resin type coating composition, a chlorinated rubber type coating composition and a vinyl resin type coating composition.

3. The process according to the claim 1, wherein the scaly pigment is glass flake, micaceous iron oxide, aluminum powder, talc or mica, or a mixture thereof.

4. The process according to claim 1, wherein the air-drying finish coating composition is a solvent-type coating composition selected from the group consisting of an oil-type coating composition, an alkyd resin type coating composition, an epoxy resin type coating composition, a polyurethane resin type coating composition, a chlorinated rubber type coating composition and a vinyl resin type coating composition.

5. The process according to claim 1, wherein the air-drying finish coating composition is a radical-polymerizable and oxidation polymerizable, room temperature solventless coating composition which is composed essentially of a curing catalyst and a resin component comprising (A) from 30 to 70% by weight of an oil-modified alkyd resin having an oil length of from 30 to 70% and modified with an $\alpha,\beta$-unsaturated monocarboxylic acid selected from the group consisting of sorbic acid, crotonic acid and 2-($\beta$-furyl)acrylic acid, the content of the $\alpha,\beta$-unsaturated monocarboxylic acid in the alkyd resin being from 0.5 to 30% by weight, and (B) from 70 to 30% by weight of a polymerizable monomer in which the ingredient (A) is dissolved.

* * * * *